US005914688A

United States Patent [19]

Andersson

[11] Patent Number: 5,914,688

[45] Date of Patent: Jun. 22, 1999

[54] DEVICE IN ANTENNA UNITS

[75] Inventor: Christer Andersson, Mölndal, Sweden

[73] Assignee: Telefonaktiebolaget LM Ericsson, Stockholm, Sweden

[21] Appl. No.: 08/790,789

[22] Filed: Jan. 30, 1997

[30] Foreign Application Priority Data

Jan. 30, 1996 [SE] Sweden ..... 9600352-0

[51] Int. Cl.[6] ..... H01Q 1/38

[52] U.S. Cl. ..... 343/700 MS; 343/846; 343/850

[58] Field of Search ..... 343/700 MS, 778, 343/846, 850, 853; H01Q 1/38

[56] References Cited

U.S. PATENT DOCUMENTS 5,223,848 6/1993 Rammos et al. .
5,565,878 10/1996 Lagerlöf .
5,661,494 8/1997 Bondyopadhyay ..... 343/700 MS

FOREIGN PATENT DOCUMENTS 434 268 6/1991 European Pat. Off. .
447 218 9/1991 European Pat. Off. .
42 39 597 6/1993 Germany .
43 13 397 11/1994 Germany .

*Primary Examiner*—Don Wong
*Assistant Examiner*—Hoang Nguyen
*Attorney, Agent, or Firm*—Burns, Doane, Swecker & Mathis, L.L.P.

[57] ABSTRACT

Device in antenna units for transmission and reception, respectively of electromagnetic signals of different polarizations, consisting of at least two antenna elements, and feeder networks for feeding the antenna elements. The feeder networks comprise a primary feeder network which is arranged for direct feeding of at least one of said antenna elements with signals of a first polarization, and at least a second of the antenna elements with signals of a second polarization. There is also a secondary feeder network arranged to mutually connect those antenna elements which through the primary feeder network are directly fed with signals of different polarization, whereby all of the antenna elements are fed with signals of all the different polarizations.

7 Claims, 1 Drawing Sheet

DEVICE IN ANTENNA UNITS

TECHNICAL FIELD

The present invention relates to a device in antenna units for transmission and reception of electromagnetic signals of different polarizations, said device consisting of at least two antenna elements and feeder networks for feeding of the antennna elements.

BACKGROUND OF THE INVENTION

During information transmission via electromagnetic signals there will occur large local variations in signal strength, due to interference between signals received directly, and signals which have been reflected against various objects, e.g. buildings, or signals which have been reflected against the terrain.

In order to reduce these problems, so called diversity reception can be used, which means reception using at least two antenna units, the received signal strength of which is monitored so that maximal signal strength can be used for reception. The so far most widely used form of diversity reception is so called space diversity, which means using at least two antennas separated in space. When using directive antennas with sector spacing, several antennas are needed, thus taking up a great deal of space. This means high production and installation costs, and a negative esthetic influence, for example base stations for mobile telephony systems, which in many cases are located in densely populated areas. In order to obviate these problems, polarization diversity can be used instead, where one and the same antenna unit can be used with dual polarization. This enables reception of signals, the polarization of which has been twisted due to reflections of the electromagnetic signal against surrounding objects. The antennas are often constructed using so called microstrip technology. Known dual polarized microstrip have the drawback of a complex feeder network, where each polarization requires one feeder network.

DE 4 239 597 A1 shows a so called microstrip antenna, with dual polarization, in which the antenna elements for the different polarizations are located in different layers. This leads to a complex structure, with a large amount of layers for both the antenna elements and the feeder networks, which causes high costs.

The object of the present invention is a device in antenna units, in which the feeder network is greatly simplified and compressed.

SUMMARY OF THE INVENTION

The said object is achieved through a device according to the present invention, which is characterized in that said feeder network consists of a primary feeder network which is arranged for direct feeding of at least one of said antenna elements with signals of a first polarization, and at least one second antenna element with signals of a second polarization, and a secondary feeder network which is arranged to mutually connect those antenna elements which are fed directly by the primary feeder network with signals of different polarizations, whereby all the antenna elements are fed with signals of the different polarizations.

Through the combination of direct feeding of the antenna elements and a mutual secondary feeding of the elements a feeder network is achieved which is highly simplified and compressed.

BRIEF DESCRIPTION OF THE DRAWINGS

The invention will now be described by way of example only, with reference to the attached drawings, in which.

DETAILED DESCRIPTION OF A PREFERRED EMBODIMENT

Figure 1:
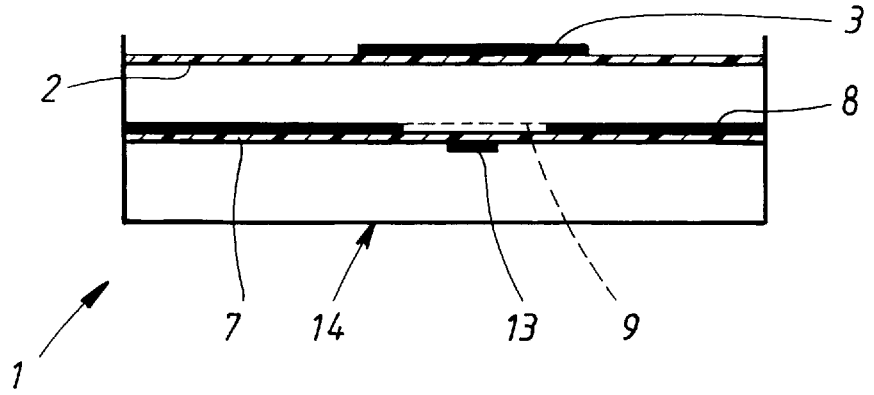
FIG. 1 shows a schematic cross section of an antenna unit according to the invention, and FIG. 2 schematically shows an elevated view of the antenna unit
Figure 2:
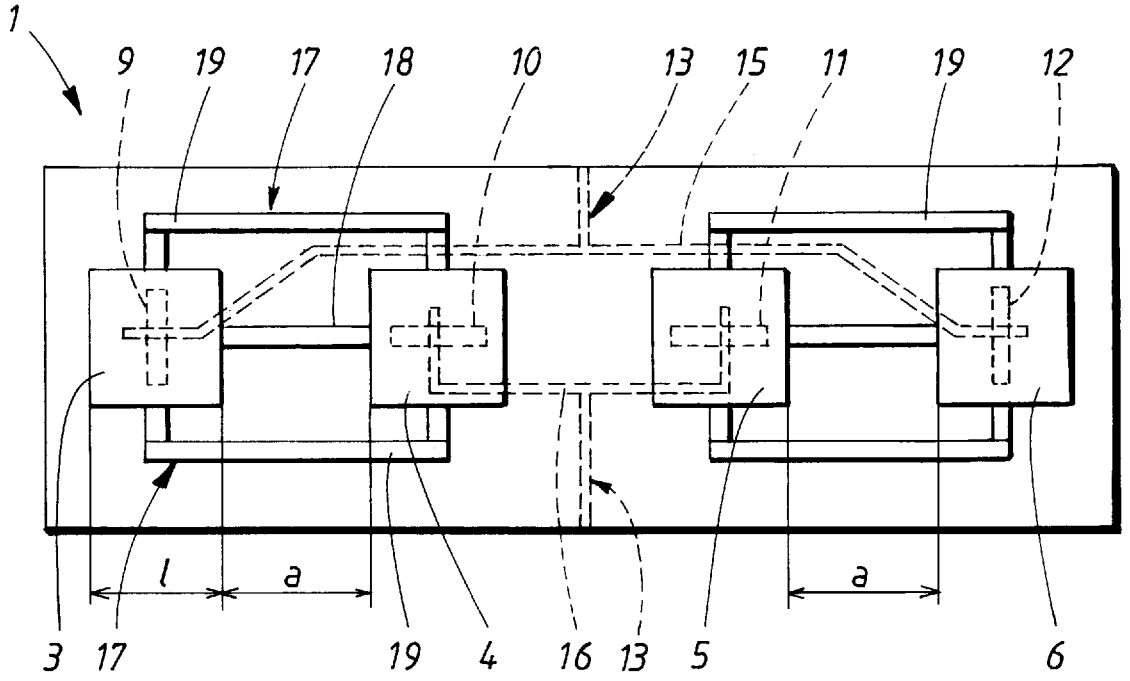

FIGS. 1 and 2 very schematically show an antenna unit 1 for electromagnetic radiation, which e.g. is intended for use in a base station for mobile, wireless telecommunication, e.g. using radiowaves within the microwave area.

The antenna unit is preferrably designed as a micro strip antenna, i.e. a planar antenna, constructed on a disk-shaped bearer 2, of an electrically isolating material, for example a plate of a relatively rigid material, e.g. glass fibre material or a polymer material. The bearer suppports en electrically conducting layer which forms a circuit design formed by e.g. etching of a copper laminate, i.e. a PC-plate or printed circuit plate. The bearer 2 supports several radiation elements in the shape of antenna elements 3,4,5,6, also called patches, which in the example shown are shaped as squares, arranged in a row, of which there are, in the example shown, four. The antenna elements are arranged in one and the same plane, which forms the antenna plane, also called the patch layer.

At a distance from the patch layer there is arranged a second bearer 7, which can have the same mechanical construction as the patch layer, i.e. an electrically isolating plate which supports an electrically conducting layer.

This second bearer supports, on the side which faces the antenna plane, an electrically conducting layer which covers virtually the entire surface of the bearer, and forms a ground plane 8, which extends parallel to the antenna plane or patch layer. The ground plane 8 in a known manner forms a screening and reflecting surface, which reinforces the directive effect of the antenna elements 3–6, and thus influences the radiation pattern of the antenna unit.

The ground plane 8 has an aperture in the shape of an elongated opening, 9,10,11,12, facing the middle of each antenna element 3–6. Using the apertures, the signal is polarized so that it via the apertures radiates towards the corresponding antenna element with the chosen polarization. The polarization is determined by the orientation of the apertures, so that the vertically oriented apertures cause a horizontal polarization, while the horizontally oriented apertures cause vertical polarization.

The disk-shaped bearer 7 also has, on the side distant from the antenna element, an electrically conducting layer in the shape of a certain circuit pattern, which forms a third layer, i.e. a primary feeder network 13, extending parallel to the ground plane and the antenna plane.

The two disk-shaped bearers 2,7, and thereby the patch layer, the aperture layer and the layer of the primary feeder network, are preferrably supported by a supporting structure 14 in the shape of an electrically conducting cover which affords both mechanical protection and electrical shielding.

The primary feeder network 13 is arranged to feed electromagnetic signals of different polarizations, e.g. vertical and horizontal, to the antenna elements 3–6 through the apertures 9–12. Each separate antenna element is fed with signals of one of these polarizations. For this purpose there is a first feeder strip 15, arranged to feed two of the antenna elements, 3,6, via the apertures 9,12, with horizontally polarized signals, while a second feeder strip 16 is arranged to feed the antenna elements 4,5, via the apertures 12,11 with vertically polarized signals. For this purpose the apertures 9,10,11,12, are oriented for the intended polarization.

The antenna unit 1 according to the invention furthermore has a secondary feeder network 17, which is arranged in the antenna plane, i.e. the patch layer. The secondary feeder network 17 is arranged to transmit signals from the elements 3,6, which have been directly fed with the first polarization, to the other antenna elements 4,5, and vice versa. To this end, the secondary feeder network has a first feeder strip 18 for feeding signals with horizontal polarization from each of the antenna elements 3,6, to the antenna elements 4,5 while further feeder strips 19 are arranged to feed signals of vertical polarization from each of the antenna elements 4,5, to the antenna elements 3,6.

When adjusting the length of the strips to the wavelength, the strips 18,19, should have an length of $a=N*\lambda/2$, where N is an integer not equal to zero, and $\lambda$ is the wavelength in the material being used.

The invention thus shows a feeder network which is highly simplified and compressed, and symmetrical, which reduces the negative effect of the feeder network on the antenna diagram.

In the shown embodiment, the secondary feeder network especially, is symmetrical in the longitudinal and latidunal extensions of the antenna, in respect to those antenna elements which it connects.

Through the design described above, all the antenna elements 3–6 are fed with both polarizations, and can thereby transmit and receive signals of both polarizations. The antenna unit can thus work in a completely reciprocal manner, but usually there is only transmission with one polarization, while reception is on both polarizations, since diversity is especially frequent on reception. "Feeding" here means both "feeding to", as well as "feeding from", e.g. the antenna elements.

What is claimed is:

1. Device for transmission and reception respectively, of electromagnetic signals of different polarizations, comprising at least two antenna elements and a feeder network for feeding the antenna elements, wherein the antenna elements are arranged in an antenna layer, and said feeder network includes a primary feeder network which is arranged in a layer separate from the antenna layer, and is arranged to directly feed at least one of said antenna elements with signals of at least a first polarization, and at least a second of the antenna elements with signals of a second polarization, and a secondary feeder network which is arranged to mutually connect those antenna elements which through the primary feeder network are directly fed with signals of different polarizations, whereby all of the antenna elements are fed with signals of the different polarizations and at least one ground plane, located at a distance from said antenna plane, wherein said primary feeder network is connected to said ground plane by a parallel support plane, and said secondary feeder network is arranged in the antenna plane.

2. Device according to claim 1, wherein the ground plane has apertures facing the middle of each antenna element, and which are arranged to feed signals of the different polarizations, each antenna element being fed with one of the said polarizations.

3. Device according to claim 2, wherein said secondary feeder network has at least one first feeder strip between two antenna elements, in order to transmit signals from one of the antenna elements which is directly fed with signals of the first polarization to the other antenna element, and at least one second feeder strip to transmit signals to the first antenna element from the second antenna element which is fed directly with signals of the second polarization.

4. Device according to claim 3, wherein the antenna elements are arranged in pairs, and in that the first feeder strip in the primary feeder network is arranged to directly feed one of the antenna elements of each pair, and in that the other feeder strip in the primary feeder network is arranged to directly feed the other antenna element of each pair.

5. Device according to claim 1, wherein the primary feeder network comprises at least one first feeder strip for feeding signals to apertures, which are oriented for the first polarization, and at least one second feeder strip for feeding signals to apertures which are oriented for the second polarization.

6. Device according to claim 1, wherein the secondary feeder network, in respect to those antenna elements which it connects, is symmetrical in the longitudinal and latitudinal extensions of the antenna.

7. Device according to claim 1, wherein the secondary feeder network is symmetrical.

* * * * *